US008459835B2

(12) United States Patent
Liu et al.

(10) Patent No.: US 8,459,835 B2
(45) Date of Patent: Jun. 11, 2013

(54) LIGHT EMITTING DIODE LAMP

(75) Inventors: Tay-Jian Liu, Tu-Cheng (TW); Hong-Bing Wang, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 178 days.

(21) Appl. No.: 13/117,161

(22) Filed: May 27, 2011

(65) Prior Publication Data

US 2012/0162987 A1 Jun. 28, 2012

(30) Foreign Application Priority Data

Dec. 23, 2010 (CN) ..... 2010 1 0602813

(51) Int. Cl.
*F21V 13/00* (2006.01)

(52) U.S. Cl.
USPC ..... 362/249.02; 362/580; 362/240; 362/236; 362/294

(58) Field of Classification Search
USPC ..... 362/580, 547, 218, 294, 345, 235, 362/240
See application file for complete search history.

(56) References Cited

U.S. PATENT DOCUMENTS

| | | | | |
|---|---|---|---|---|
| 7,988,321 | B2 * | 8/2011 | Wung et al. | 362/218 |
| 2006/0279946 | A1 * | 12/2006 | Park et al. | 362/97 |
| 2009/0323342 | A1 * | 12/2009 | Liu | 362/249.02 |
| 2010/0172133 | A1 * | 7/2010 | Liu | 362/235 |
| 2010/0177514 | A1 * | 7/2010 | Liu et al. | 362/235 |

* cited by examiner

*Primary Examiner* — Mariceli Santiago
(74) *Attorney, Agent, or Firm* — Altis Law Group, Inc.

(57) ABSTRACT

A light emitting diode lamp includes a lamp base defining a plurality of openings, at least one power module, and a number of illumination modules. Each illumination module includes a number of illumination units. Two opposite terminals of each illumination unit are secured to the lamp base near two opposite edges of a corresponding opening. The illumination units are in the openings and apart from each other. Each illumination unit includes a heat dissipating assembly, at least one lighting assembly, and two connection units connected to two opposite terminals of the heat dissipating assembly. The power module supplies electrical power to at least one illumination module, and controls a power supply through at least one of the two connection units to electrically connect the at least one lighting assembly.

20 Claims, 7 Drawing Sheets

LIGHT EMITTING DIODE LAMP

BACKGROUND

1. Technical Field

The present disclosure relates to a light emitting diode (LED) lamp, and particularly, to an illumination module of an LED lamp.

2. Description of Related Art

LEDs have many advantages, such as high luminosity, low operational voltage, low power consumption, easy driving, long-term reliability, environmental friendliness for not having to use mercury (Hg), and high impact resistance, which have led to LEDs being widely used as light sources.

Radiant efficiency and lifespan of the LEDs may be distinctly reduced by high working temperatures if an LED illumination device does not include a highly efficient heat dissipating assembly.

Large LED illumination devices, such as streetlights, spotlights, and searchlights, include a base, a heat dissipating assembly defining a number of fins on one side of the base, an LED light source mounted on the base opposite to the heat dissipating assembly, a housing enclosing the LED light source, and a driving power source to drive the LED light source. However, the heavy weight and huge volume of the heat dissipating assembly cause a lot of work and cost for configuration, disassembly, and repair, especially for hanging illumination devices, such as streetlights.

In addition, because of various illumination applications and customer needs, different kinds of illumination devices are designed having quite different structures, since one illumination device usually cannot be adopted to different illumination applications. As such, design, development, and manufacture of the LED illumination devices are costly.

Accordingly, it is desirable to provide an LED lamp which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the disclosure are now described in detail with reference to the accompanying drawings.

Figure 1:
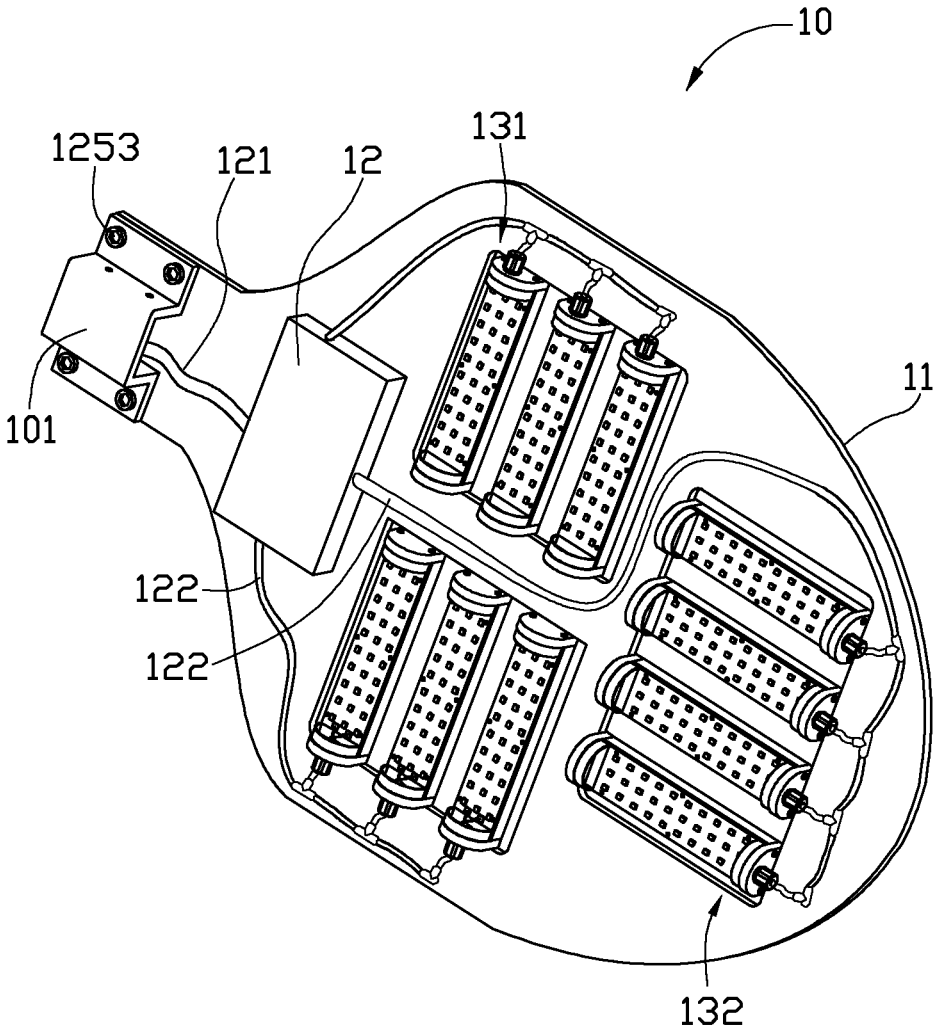
FIG. 1 is an assembled, isometric view of an LED lamp according to a first embodiment of the present disclosure.
Figure 2:
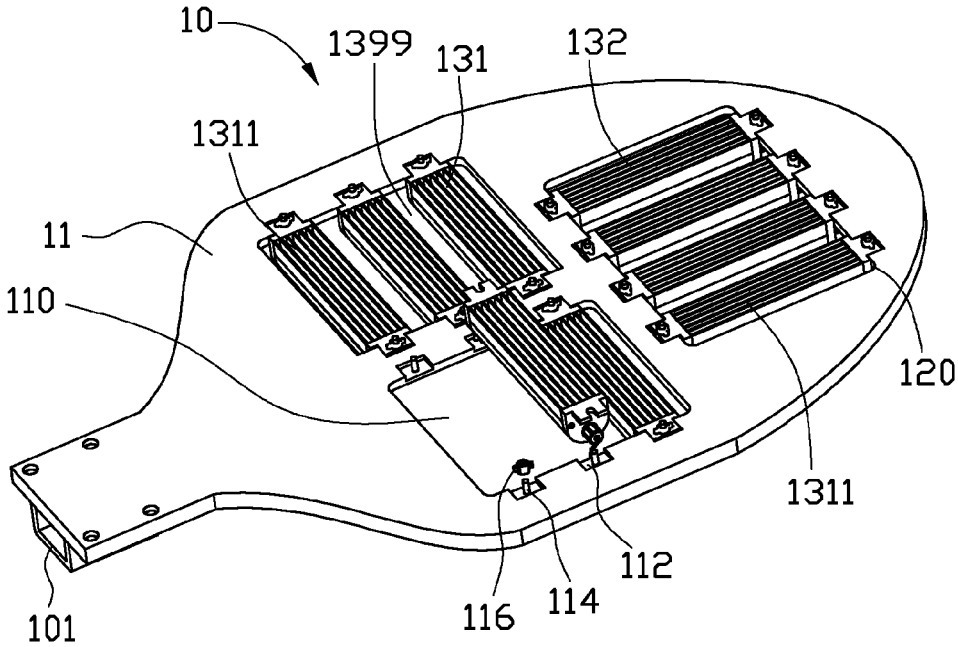
FIG. 2 is a partially assembled view of the LED lamp of FIG. 1, but viewed from the back side.

Referring to both FIG. 1 and FIG. 2, an LED lamp 10 in accordance with the present disclosure includes a lamp base 11, a power module 12, two illumination modules 131, one illumination module 132, a pole connection unit 101, a trunk power cord 121, three branch power cords 122, and four screws 1253. The LED lamp 10 is, for example, a streetlight. In this embodiment, the LED lamp 10 is substantially symmetrical to a central line thereof. The pole connection unit 101 is fixed to the lamp base 11 by the four screws 1253, and can be connected to a pole or other support (not shown).

The lamp base 11 defines two openings 110 corresponding to the two illumination modules 131, and one opening 120 corresponding to the illumination module 132. Each of the openings 110 and 120 is substantially a rectangular opening. The lamp base 11 further defines recesses 112 neighboring the openings 110 and 120, and has threaded bolts 114 in the recesses 112 to hold the illumination module 131 and 132 in the openings 110 and 120. Both the recesses 112 and the threaded bolts 114 are located at the back side (FIG. 2) of the LED lamp 10, not penetrating the lamp base 11.

Differences between the openings 110 and the opening 120 lie in positions, sizes, numbers, and locations of the recesses 112 and threaded bolts 114. The opening 120 is located far from the pole connected unit 101, and is parallel to the central line. There are eight recesses 112 and eight threaded bolts 114 adjacent to the opening 120. Four of the recesses 112 are located near an edge of the opening 120 far from the pole connected unit 101, and the other four recesses 112 are located near another edge of the opening 120 opposite thereto. The two openings 110 are located between the above-mentioned opening 110 and the pole connected unit 101, and are perpendicular to the central line. The two openings 110 are identical to each other, and symmetrical to the central line. There are six recesses 112 and six threaded bolts 114 adjacent to each opening 110. Three of the recesses 112 are located near an edge of the opening 110 adjacent to the central line, and the other three recesses 112 are located near another edge of the opening 110 opposite thereto.

Differences between the illumination modules 131 and the illumination module 132 lie in positions, sizes, numbers, and directions of illumination units 1311. Each illumination module 131 includes three illumination units 1311 located in one of the openings 110, and six T-nuts 116 located at two opposite ends of the three illumination units 1311. Each illumination unit 1311 of the illumination modules 131 is arranged perpendicular to the central line of the LED lamp 10. The illumination module 132 includes four illumination units 1311 located in the opening 120, and eight T-nuts 116 located at two opposite ends of the four illumination units 1311. Each illumination unit 1311 of the illumination module 132 is arranged parallel to the central line of the LED lamp 10.

The trunk power cord 121 enters the LED lamp 10 from the space defined between the pole connection unit 101 and the lamp base 11. The LED lamp 10 adopts the single power module 12 to control the driving power supplied to all illumination units 1311 in this embodiment. The power module 12 is located on the front side (FIG. 1) of the lamp base 11 and near the pole connection unit 101, so the trunk power cord 121 is easily connected to an input port of the power module 12. The branch power cords 122 are also located on the front side of the lamp base 11. The three branch power cords 122 individually connect output ports of the power module 12 to the three illumination modules 131 and 132. The power module 12 includes a printed circuit board (not shown), and an electric insulating case housing the printed circuit board or a thermally conductive and electric insulating material enclosing the printed circuit board. The electric insulating case or the thermally conductive and electric insulating material can enhance electric safety, reliability, weatherproof, and heat dissipation of the power module 12. For each illumination unit 1311, current is supplied from power module 12 through one branch power cord 122.

The illumination units 1311 are assembled to the lamp base 11 from the back side. Two opposite ends of each illumination unit 1311 are respectively positioned in two opposite recesses 112, and are penetrated by two threaded bolts 114. The T-nuts 116 are respectively screwed to the threaded bolts 114 to fix the illumination units 1311. The illumination units 1311 are apart from each other, and define gaps 1399 therebetween to enhance natural convection for heat dissipation, and to reduce weight of the LED lamp 10. The gaps 1399 allow wind, snow, rainwater and dust to pass through, so as to prevent possible loads caused by these foreign materials on the LED lamp 10.

Figure 3:
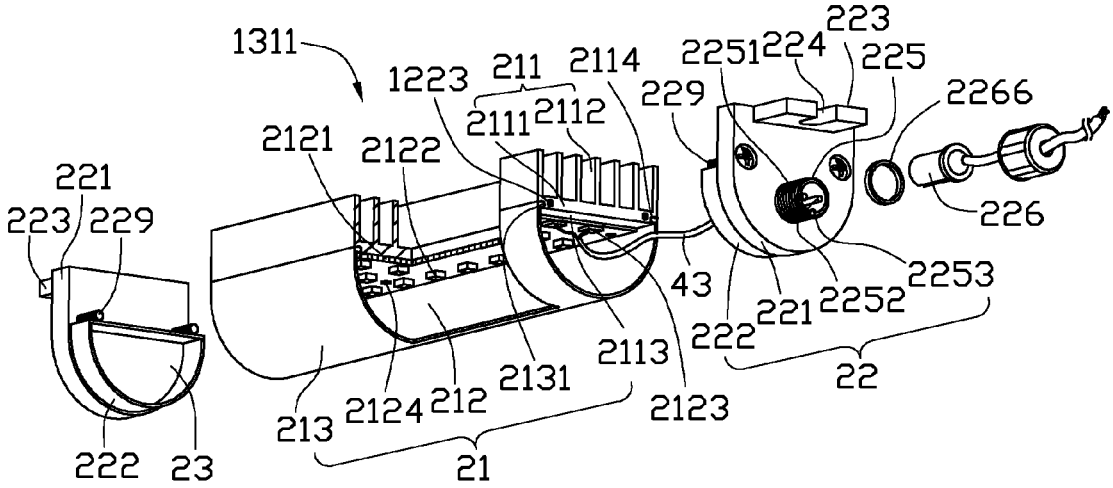
FIG. 3 shows a partially exploded view of an illumination unit of FIG. 1.

As shown in FIG. 3, each illumination unit 1311 is relatively long and narrow. Each illumination unit 1311 includes a long lamp module 21, and two connection units 22 and 23 connected to two opposite terminals of the lamp module 21. Each lamp module 21 includes a long heat dissipating assembly 211, at least one lighting assembly 212, and a long light guide housing 213.

The heat dissipating assembly 211 is made of thermally conductive material, such as metal. The heat dissipating assembly 211 includes a heat dissipating base 2111 and a number of fins 2112 on one side of the heat dissipating base 2111. Located corresponding to each of the opposite terminals of the lamp module 21, the heat dissipating base 2111 further defines two screw holes 1223. The heat dissipating assembly 211 provides an effective means for dissipating heat generated from the at least one lighting assembly 212 of the lamp module 21 to ensure the reliability of the illumination unit 1311.

The heat dissipating base 2111 is substantially a plate. The other side of the heat dissipating base 2111 opposite to the fins is an endothermic surface 2113 contacting the at least one lighting assembly 212. Two parallel grooves 2114 respectively located on two lateral edges of the heat dissipating base 2111. Two terminal edges of the light guide housing 213 are received in the two grooves 2114, and can be adhered to the grooves 2114. As such, the heat dissipating base 2111 can seal the light guide housing 213.

The fins 2112 are rectangular long plates extending away from the heat dissipating base 2111, and are located opposite the at least one lighting assembly 212 to achieve heat dissipation. It is noted that the heat-dissipating structures are not limited by the drawings, and may include any appropriate shapes, such as pins, louvers or short plates.

The at least one lighting assembly 212 is located under the heat dissipating assembly 211. The lighting assembly 212 includes a rectangular light source base 2121, a number of LED elements 2122, and a number of electrodes 2123. One surface of the light source base 2121 of the lighting assembly 212 contacts the endothermic surface 2113 of the heat dissipating base 2111. The electrodes 2123 and the LED elements 2122 are formed on the other surface of the light source base 2121 opposite the endothermic surface 2113. The electrodes 2123 are electrically connected to the LED elements 2122. Each LED element 2122 may include at least one LED chip hermetically sealed by a transparent material.

The heat dissipating base 2111 may include a thermal interface material (TIM, not labeled) coated between the light source base 2121 and the endothermic surface 2113. The light source base 2121 may be tightly fixed to the heat dissipating base 2111 by screws 2124. The heat produced from the LED elements 2122 can be effectively transferred from the lighting assembly 212 to the nearby fins 2112. The temperature differences among the illumination units 1311 and the surroundings causes natural convection in the gaps 1399, and the large outer surface of the heat dissipating assembly 211 and the gaps 1399 make the natural convection more active. Thus, heat dissipation of the present disclosure is better than that of the transitional LED lamp.

The branch power cord 122 is electrically connected to the electrodes 2123 of the light source base 2121 to transmit driving current to the lighting assembly 212, and controls the power supplied to the LED elements 2122.

The light guide housing 213 is a transparent arc shaped housing covering the lighting assembly 212. The light guide housing 213 includes two flanges 2131 respectively at two lateral edges corresponding to the two grooves 2114 of the heat dissipating base 2111. The two flanges 2131 are parallel to the extension direction of the lamp module 21. The two flanges 2131 extend inward and respectively insert into the two grooves 2114 of the heat dissipating base 2111. As such, the light guide housing 213 is fixed to the heat dissipating base 2111. The light guide housing 213 can adjust the illumination distribution of the LED lamp 10, and protects the lighting assembly 212.

The two connection units 22 and 23 are located at two opposite terminals of the lamp module 21, and hermetically seal the lamp module 21. Each of the connection units 22 and 23 includes a cover 221 and two screws 229.

Each cover 221 includes a location piece 222 facing the lamp module 21 and a protrusion piece 223 opposite to the lamp module 21. The location pieces 222 are respectively inserted into two opposite terminals of the lamp module 21 and contact the inner surface of the light guide housing 213. For each of the connection units 22 and 23, the two screws 229 penetrate the cover 221 and the screw holes 1223, so the connection units 22 and 23 hermetically seal the lighting assembly 212, to make the illumination unit 1311 waterproof.

Each protrusion piece 223 defines a hole 224. Each illumination unit 1311 is fixed to the lamp base 11 by two threaded bolts 114 shown in FIG. 2 penetrating the two holes 224, and the two T-nuts 116 shown in FIG. 2 respectively screwed on the two threaded bolts 114. Accordingly, each illumination unit 1311 can be easily posited and fixed on the lamp base 11 without tools.

Figure 4:
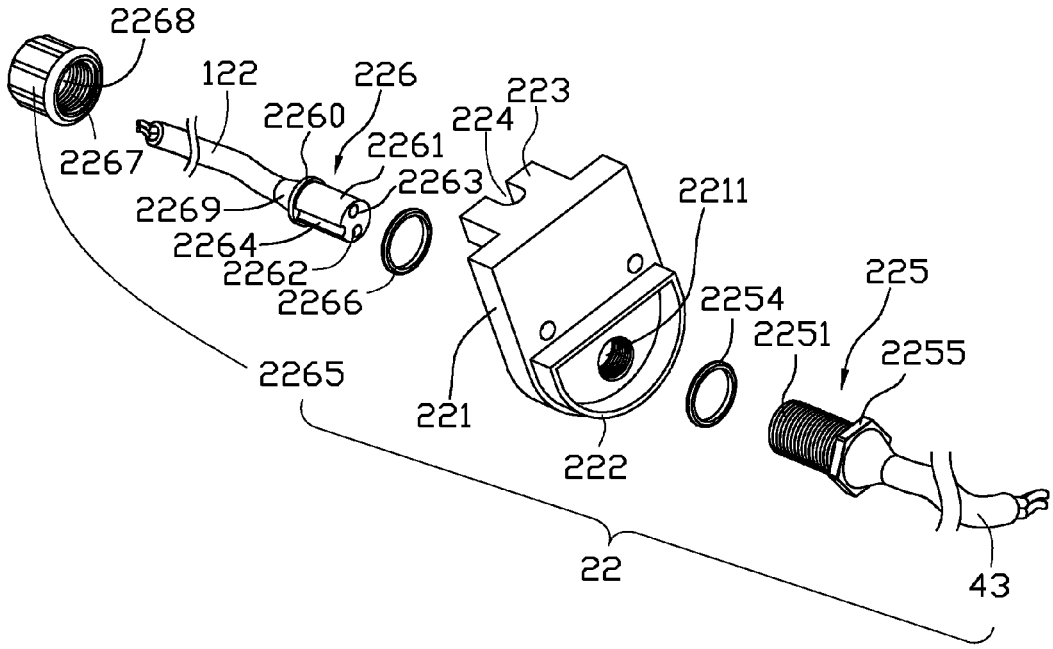
FIG. 4 is an exploded view of one of the connection units of FIG. 3, viewed from an opposite side and the power connection.

Referring to both FIG. 3 and FIG. 4, deferent from the connection unit 23, the connection unit 22 shown in the right of FIG. 3 further includes a power cord 43, two seal rings 2254 and 2266, and a cap 2265, and the cover 221 of the connection unit 22 further defines a threaded hole 2211 to hold the power cord 43.

The power cord 43 includes a first terminal 225 to connect with the branch power cord 122, and the first terminal 225 is substantially a plug. The first terminal 225 includes a fixing portion 2251, two contact pins 2252 located in the fixing portion 2251, a hexagonal head portion 2255, and a tenon bar 2253 on the inner surface of the fixing portion 2251. The fixing portion 2251 is substantially a hollow column, defining threads on the outer surface.

The branch power cord 122 includes a second terminal 226 inserted into the fixing portion 2251, and the second terminal 226 is substantially a socket. The second terminal 226 includes an electrically insulating socket column 2261, a circular protrusion portion 2260, a cone portion 2269, and two conductive pieces 2263 for engagingly receiving the contact pins 2252. The circular protrusion portion 2260 is located between the socket column 2261 and the cone portion 2269. The socket column 2261 defines two socket holes 2262 for engagingly receiving the two conductive pieces 2263, and a locking groove 2264 for engagingly receiving the tenon bar 2253. The conductive pieces 2263 may be metal.

The cap 2265 defines a hole 2268 at the center of the end to hold the branch power cord 122, and threads 2267 on the inner surface to threadedly engage with the threads on the outer surface of the fixing portion 2251.

Connection of the connection unit 22 includes threading through the seal ring 2254 with the fixing portion 2251, and screwing the fixing portion 2251 into the threaded hole 2211 of the cover 221. Accordingly, threads on the inner surface of the threaded hole 2211 threadedly engage with the threads of the fixing portion 2251, and the seal ring 2254 is tightly sandwiched by the hexagonal head portion 2255 and the cover 221. The seal ring 2254 hermetically seals the threaded hole 2211. The fixing portion 2251 and the contact pins 2252 protrude from the cover 221. Next, the illumination units 1311 are fixed to the lamp base 11. Thereafter, the cap 2265 and another seal ring 2266 are threaded through by the branch power cord 122. Afterward, the second terminal 226 inserts into the fixing portion 2251. The tenon bar 2253 and the two contact pins 2252 respectively slip into the locking grooves 2264 and two socket holes 2262. The two contact pins 2252 contact the two conductive pieces 2263 in the socket holes 2262. Accordingly, currents are supplied from the trunk power cord 121, the branch power cord 122, and the power cord 43 to the LED elements 2122. Next, the cap 2265 is screwed onto the fixing portion 2251. The cap 2265 pushes the second terminal 226 and the seal ring 2266, so the seal ring 2266 is tightly sandwiched by the circular protrusion portion 2260 and the fixing portion 2251. Connection between the first terminal 225 and the second terminal 226 is waterproof.

Both the branch power cord 122 and the power cord 43 include two wires therein to supply currents which flow from p-type material to n-type material in LEDs.

Accordingly, the LED lamp 10 can be easily assembled and disassembled without tools. The illumination modules 131 and 132 and the illumination units 1311 of the present disclosure can be produced in batches, and numbers and arrangements of the illumination modules 131 and 132 and the illumination units 1311 can be easily adjusted. Since the LED lamp 10 is formed by the modularized illumination modules 131 and 132 and illumination units 1311, the LED lamp 10 can be easily modified for various applications. In addition, the connection units 22 and 23 enable easier manual repair of the suspended LED lamp. Repairmen can quickly replace the illuminating unit 12 without tools.

Figure 5:
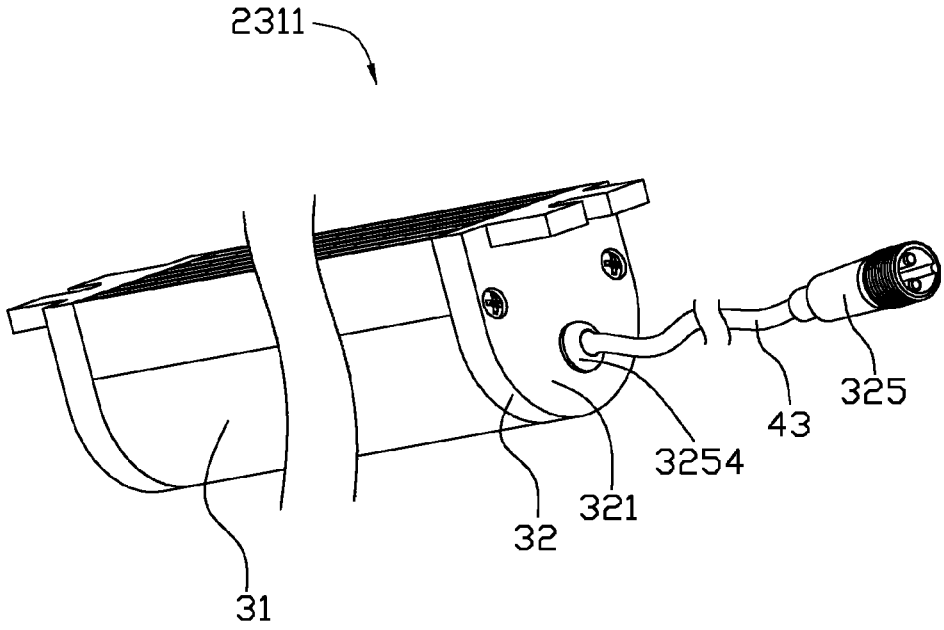
FIG. 5 is an assembled, isometric view of an illumination unit according to a second embodiment of the present disclosure.

FIG. 5 illustrates an illumination unit 2311 according to a second embodiment of the present disclosure. As shown in FIG. 5, the main differences between the illumination unit 1311 and the illumination unit 2311 are the structure of the connection unit 32 and the position of the first terminal 325. The connection unit 32 includes a seal ring 3254 set between the power cord 43 and a wire hole of the cover 321. The seal ring 3254 is elastic, and tightly engages with both the power cord 43 and the wire hole to hermetically seal the illumination unit 2311. So the lighting assembly 31 can be waterproof. The first terminal 325 connecting to the power cord 43 is located outside the cover 321 of the connection unit 32. Thus, the positions of the first terminal 325 and the second terminal 226 of FIG. 3 do not have to be limited to be adjacent to the connection unit 32. In this embodiment, the first terminal 325 is away from the illumination unit 2311, and the designs of LED lamp can be more versatile.

Figure 6:
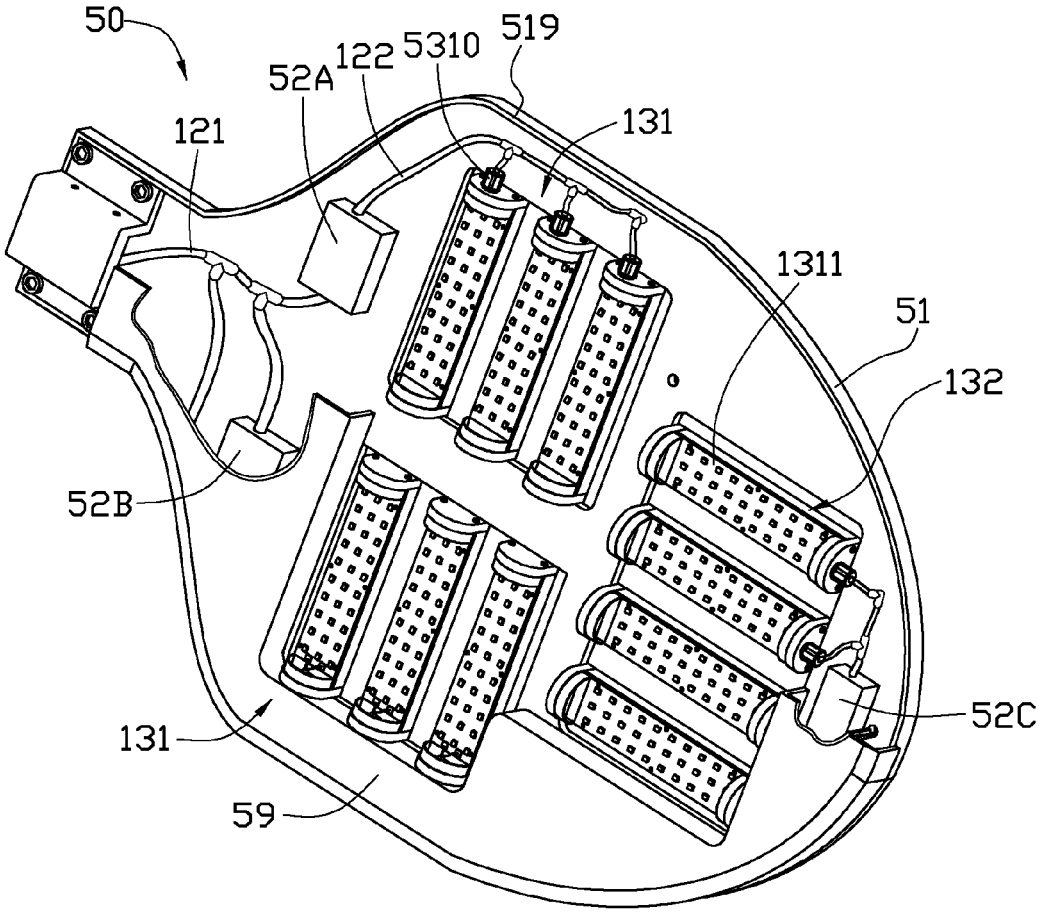
FIG. 6 is a partial isometric view of an LED lamp according to a third embodiment of the present disclosure, in which a portion of a lamp cover is not shown.
Figure 7:
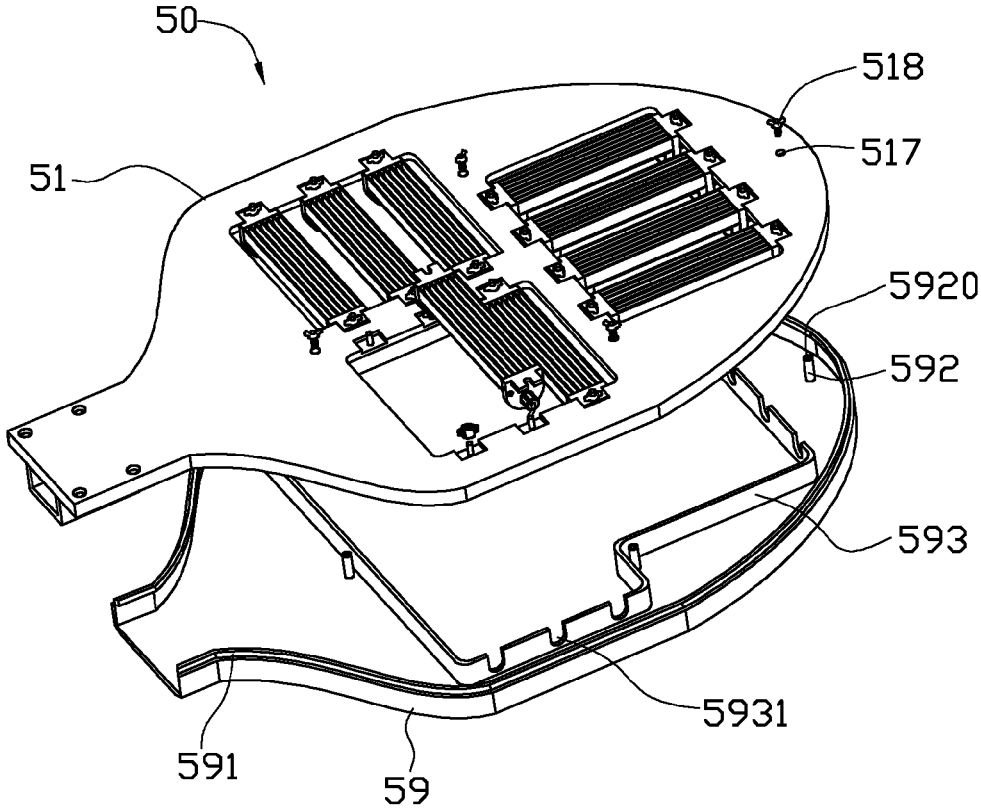
FIG. 7 is a backside view during assembly process of the LED lamp of FIG. 6.

FIG. 6 and FIG. 7 illustrate an LED lamp 50 according to a third embodiment of the present disclosure. As shown in FIG. 6 and FIG. 7, the main difference between the LED lamp 10 and the LED lamp 50 is that the LED lamp 50 includes three power modules 52A, 52B and 52C to respectively control two illumination modules 131 and one illumination module 132, and that the LED lamp 50 further includes a lamp cover 59. The lamp cover 59 not only improves the look of the LED lamp 50, but also enhances the weatherproof of the power modules 52A, 52B and 52C.

The shape of the lamp cover 59 substantially corresponds to the lamp base 51, and overlaps the sidewalls of the illumination modules 131, 132 and the lamp base 51. The lamp cover 59 includes a stepped sidewall 591 corresponding to the sidewall 519 of the lamp base 51, an inner wall 593 surrounding the illumination modules 131 and 132. The sidewall 519 of the lamp base 51 fittingly engages with the stepped sidewall 591 of the lamp cover 59. The lamp cover 59 defines four protrusion cylinders 592 corresponding to four holes 517 of the lamp base 51, and each protrusion cylinder 592 defines a threaded hole 5920 therein. The inner wall 593 defines ten openings 5931 to hold terminals of the illumination units 1311, 2311.

Assembly of the lamp cover 59 includes positioning the lamp cover 59 on a predetermined position of the lamp base 51, on which the outer surface of the stepped sidewall 591 hermetically engages with the inner surface of the sidewall 519, and next screwing four wing screws 518 respectively through the four holes 517 into the four threaded holes 5920. The lamp cover 59 and the lamp base 51 define a receiving space located between the stepped sidewall 591 and the inner wall 593 to receive the trunk power cord 121, the branch power cords 122 and the power modules 52A, 52B and 52C.

The illumination units 1311 are replaced by the illumination units 2311 in other embodiments, the openings 5931 function as through holes for the power cords 43, and the design of the lamp cover 59 can be varied.

Any of the above-mentioned electrical connections can be changed as required. For example, any of the first terminals 225, 325 (plug) can be replaced by a socket, and any of the second terminals 226 can be replaced by a plug. In another embodiment, one illumination unit 1311, 2311 may include both a plug and a socket located on two terminals thereof to connect to corresponding socket and plug of the branch power cord.

The illumination units 1311, 2311 integrate optics and heat dissipation, and can be operated individually by the electrical connection to at least one power module 12, 52A, 52B, 52C. The sizes, numbers and arrangements of the illumination modules 131, 132, the lamp cover 59, the lamp base 11, 51 and the illumination units 1311, 2311 are not limited by the above-mentioned embodiments, and can be adjusted as required. The components and arrangements in the two embodiments can be applied to each other as required.

Accordingly, the present disclosure includes the following advantages:

First, the LED lamp of the present disclosure can be easily modified because of the use of the modularized illumination units. The illumination units integrate optics and heat dissipation, and can be operated individually by the electrical connection to at least one power module. The numbers, sizes, arrangements and shapes of the illumination modules, power module, the connection units, the lamp base, the lamp cover, the illumination units and the openings can be easily modified and recombined. Thus, various applications and customer needs can be easily achieved. The manufacture of the LED lamps is simplified, and the cost can be effectively reduced.

Secondly, the LED lamp of the present disclosure provides great thermal efficiency. The heat dissipating assembly has a large heat absorbing area and a large dissipating area, and the gaps between the illumination units enhance natural convection. As such, illuminating efficiency and light weight of the LED lamp are ensured, and lifetime of the LED lamp is increased.

Thirdly, the LED lamp of the present disclosure reduces the cost of assembly and disassembly and repair. The connection units enable easier manual repair of the suspended LED lamp. Repairmen can quickly replace the illuminating unit without tools. Accordingly, the LED lamp provides better maintenance quality, assembly convenience, and disassembly convenience.

Fourthly, the present disclosure provides an outdoor LED lamp with excellent weatherability. The LED lamp is protected from rain, humidity, dust, sunshine. The snow load, the drag coefficient, the amount of dust and sand deposition are reduced. Thus, safety and reliability are enhanced.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A light emitting diode (LED) lamp, comprising:

a lamp base, the lamp base defining a plurality of openings;

a plurality of illumination modules located on the lamp base and corresponding to the plurality of openings, each of the plurality of illumination modules comprising:

a plurality of illumination units apart from each other, each of the plurality of illumination units comprising:

a heat dissipating assembly;

at least one lighting assembly contacting the heat dissipating assembly whereby heat generated by the at least one lighting assembly is absorbed by the heat dissipating assembly; and two connection units respectively connecting two opposite terminals of the heat dissipating assembly;

at least one power module supplying electrical power to at least one illumination module, the at least one power module controlling a power supply through at least one of the two connection units to electrically connect the at least one lighting assembly; and a lamp cover located on the lamp base, wherein the lamp cover overlaps sidewalls of the plurality of illumination modules and the lamp base.

2. The LED lamp of claim 1, wherein the outer sidewall of lamp base is located along an outer edge thereof and extends toward the lamp cover, and the outer sidewall of the lamp cover is a stepped sidewall engaging with the outer sidewall of the lamp base.

3. The LED lamp of claim 1, wherein a gap is defined between two neighboring ones of the plurality of illumination units for facilitating natural convection between the illumination units.

4. The LED lamp of claim 1, wherein the lamp cover define a plurality of openings therein to hold terminals of the plurality of illumination units.

5. The LED lamp of claim 1, further comprising a plurality of trunk power cords, and a plurality of branch power cords electrically connecting the plurality of trunk power cords and the plurality of illumination units.

6. The LED lamp of claim 5, wherein the lamp base and the lamp cover defines a receiving space therebetween to receive the plurality of trunk power cords, the plurality of branch power cords, and the at least one power module.

7. The LED lamp of claim 1, wherein the lamp base defines a plurality of holes, and the lamp cover defines a plurality of protrusion cylinders corresponding to the holes.

8. The LED lamp of claim 7, further comprising a plurality of wing screws respectively screwed through the plurality of protrusion cylinders and the plurality of holes of the lamp base.

9. The LED lamp of claim 1, wherein the lamp base defines a plurality of recesses near an edge of each of the plurality of openings of the lamp base and located opposite to the lamp cover, and a plurality of threaded bolts in the recesses opposite to the lamp cover, the threaded bolts being provided for holding the plurality of illumination units in position.

10. The LED lamp of claim 1, wherein each of the plurality of illumination units further comprises a light guide housing.

11. The LED lamp of claim 10, wherein the heat dissipating assembly comprises a heat dissipating base and a plurality of fins located on one side of the heat dissipating base.

12. The LED lamp of claim 11, wherein the heat dissipating base defines two parallel grooves respectively located on two lateral edges thereof.

13. The LED lamp of claim 12, wherein two terminal edges of the light guide housing are received in the two grooves of the heat dissipating base.

14. The LED lamp of claim 13, wherein each of the two connection units comprises:

a cover; and a plurality of screws for securing the cover and the seal piece to the heat dissipating assembly.

15. The LED lamp of claim 14, wherein each of the covers comprises:

a location piece facing the at least one lighting assembly and contacting an inner surface of the light guide housing; and a protrusion piece opposite to the at least one lighting assembly.

16. The LED lamp of claim 14, wherein one of the covers comprises:

a power cord connected to the at least one power module;

two seal rings located on two opposite sides of the cover; and a cap defined a hole at the center of an end to hold a corresponding one of the branch power cords and threads on inner surface to fix to the power cord.

17. The LED lamp of claim 16, wherein the power cord comprises a plug, and the corresponding one of the plurality of branch power cords comprises a socket to connect with the plug of the power cord.

18. The LED lamp of claim 17, wherein the one of the covers further defines a threaded hole to hold the power cord.

19. The LED lamp of claim 17, wherein the plug of the power cord comprises threads on an outer surface thereof to threadedly engage with both the threaded hole of the one of the covers and the threads of the cap.

20. A light emitting diode (LED) lamp, comprising:

a lamp base, the lamp base defining a plurality of openings;

a plurality of illumination modules located on the lamp base and corresponding to the plurality of openings, each of the plurality of illumination modules comprising:

a plurality of illumination units apart from each other, each of the plurality of illumination units comprising:

a heat dissipating assembly;

at least one lighting assembly contacting the heat dissipating assembly whereby heat generated by the at least one lighting assembly is absorbed by the heat dissipating assembly; and two connection units respectively connecting two opposite terminals of the heat dissipating assembly; and at least one power module supplying electrical power to at least one illumination module, the at least one power module controlling a power supply through at least one of the two connection units to electrically connect the at least one lighting assembly;

wherein each of the plurality of illumination units further comprises a light guide housing.

* * * * *